US006973942B2

(12) United States Patent
Arrigoni et al.

(10) Patent No.: US 6,973,942 B2
(45) Date of Patent: Dec. 13, 2005

(54) WEFT CARRYING GRIPPERS FOR WEAVING LOOMS AND IN GUIDING MEANS THEREOF

(75) Inventors: Massimo Arrigoni, Bergamo (IT); Francesco Alghisi, Castelli Calepio (IT)

(73) Assignee: Promatech S.p.A., Colzate (IT)

( * ) Notice: Subject to any disclaimer, the term of this patent is extended or adjusted under 35 U.S.C. 154(b) by 222 days.

(21) Appl. No.: 10/460,266

(22) Filed: Jun. 13, 2003

(65) Prior Publication Data

US 2004/0040613 A1 Mar. 4, 2004

(30) Foreign Application Priority Data

Aug. 30, 2002 (EP) ..... 02425542

(51) Int. Cl.[7] ..... D03D 47/00
(52) U.S. Cl. ..... 139/449; 139/438; 139/196.2
(58) Field of Search ..... 139/448, 196.2, 139/116.1, 438, 447, 444, 445, 449

(56) References Cited

U.S. PATENT DOCUMENTS 3,861,427 A * 1/1975 Scheidecker ..... 139/448
4,371,008 A * 2/1983 Freisler ..... 139/448
4,587,998 A * 5/1986 Egloff et al. ..... 139/448
4,870,996 A * 10/1989 Corain et al. ..... 139/1 R
5,107,903 A * 4/1992 Cinel ..... 139/449
5,176,185 A * 1/1993 Rheinganz et al. ..... 139/449
5,303,747 A * 4/1994 Arndt et al. ..... 139/449
5,345,977 A * 9/1994 Stacher ..... 139/449
6,227,259 B1 5/2001 Verclyte

FOREIGN PATENT DOCUMENTS

| | | |
|---|---|---|
| EP | 0 198 145 | 10/1986 |
| EP | 0 759 484 | 2/1997 |
| GB | 1 206 124 | 9/1970 |

* cited by examiner

*Primary Examiner*—John J. Calvert
*Assistant Examiner*—Andrew W. Sutton
(74) *Attorney, Agent, or Firm*—Young & Thompson

(57) ABSTRACT

Weft carrying grippers (1, 2), of the type wherein the grippers are made of metal and are driven in their back-and-forth movements through the shed by carbon-fibre and/or polyester straps exclusively guided from outside the shed are both characterised by a metal shoe (3, 4) integrated in the gripper and projecting from the bottom thereof, near the tip, to which it is radiussed and in that the shoe (3, 4) has a large central recess (7, 8), designed to host the ends (12, 13) of the driving strap (10, 11), which is narrower than the rest of the strap and thinner than the recess (7, 8) of the shoe.

10 Claims, 3 Drawing Sheets

WEFT CARRYING GRIPPERS FOR WEAVING LOOMS AND IN GUIDING MEANS THEREOF

The present invention relates to improvements in weft carrying grippers for shuttle-free (or continuous weft-feed) weaving looms and in means for guiding such grippers in their movement through the shed.

It is known that in this type of looms the weft is fed by pairs of grippers, one of which being a carrying gripper and the other being a drawing gripper, exchanging the weft in the centre of the shed, and that said pairs of grippers are moved back and forth by flexible straps driven by suitable toothed wheels of the loom. There are various systems for guiding the grippers and the straps along the shed. One the most recent solutions provides metal grippers carried by straps made of carbon fibre and/or suitably rigid plastic materials (for example polyester), and a rectilinear track for the gripper-bearing straps, having a metal base and the surface coated with a ceramic layer, onto which the straps slide. The straps are guided by two double rows of hook guides or by two groove guides placed outside the two ends of the shed, while no guides are provided within the shed, where straps and grippers are not guided directly, but exclusively as a result of the high inertia-induced strap tension and of the guiding action applied thereto outside said shed.

Usually, in the above-described solution, pointed carbon-fibre straps are used, which may be coated with polyester. The carrying gripper and the drawing gripper, both of chrome-plated steel, are attached to the end of the respective strap, at the area corresponding to their own tips. When this solution is adopted, although the straps separate the chrome-plated steel grippers from the ceramic surface of the track, during the acceleration and deceleration movement of the straps a vertical flexure of the strap/gripper assemblies occurs, negatively resulting in the grippers ends colliding with the ceramic layer of the track.

Furthermore, another undesirable drawback occurs, which may lead to even more serious consequences, i.e. the wear of the lower warp yarns, induced by the carbon fibre straps controlling the grippers. Indeed, when the grippers move within the shed, while the upper warp threads lay against the smooth chrome-plated steel back of the grippers, without seriously wearing out, the lower warp yarns lay against the rough surface of the strap, consequently wearing out during the reciprocal movements that occur while the loom is in use. This wear corrupts the lower warp yarns and may rapidly lead to fraying and tearing thereof. The problem, however, only occurs near the grippers—which force their way in the shed between the upper and lower warp yarns—while it does not occur at all (or only at a minor level) downstream of said grippers, where only the strap may move by floating within the shed without overstressing the lower warp yarns, the strap not being subject—due to its extreme thinness—to the pressure that, from the upper warp yarns, presses the strap itself against the lower warp yarns near the grippers, which, on the contrary, have a relevant thickness, as known.

The present invention aims at avoiding these serious problems and relates to a couple of carrying weft grippers and means for guiding their movement through the shed.

The pair of weft carrying grippers for weaving looms according to the invention is of the type wherein the grippers are made of metal and are driven in their back-and-forth movement through the shed by carbon fibre and/or polyester straps guided exclusively outside the shed and is characterised in that each of said grippers is provided with a metal shoe integrated into said gripper and projecting from the bottom thereof near the tip, to which it is radiussed, and in that said shoe is provided with a large central recess provided to host the end of the driving strap, which is narrower than the rest of the strap and thinner than the shoe recess.

In the carrying gripper of said pair of grippers, said shoe is very close to the tip of the gripper, to which it is radiussed through a short tapered area.

In the drawing gripper of said pair of grippers, said shoe is placed at the area of the gripper body preceding the tip portion of the gripper and is radiussed thereto through a short tapered area.

The means for guiding said pair of grippers in their movement through a loom shed, of the type wherein the driving straps of said grippers move on a metal track coated with ceramic, are characterised in that said straps are quite larger than the grippers, except near said grippers, and are guided by two double rows of hooks or by a pair of grooved guides placed outside the shed, and in that at least the parts placed outside the shed of said track have a large central longitudinal groove, provided to host the shoe of said grippers.

The invention will hereafter be described more in detail, with reference to the appended drawings, which show a practical embodiment thereof, wherein.

Figure 1:
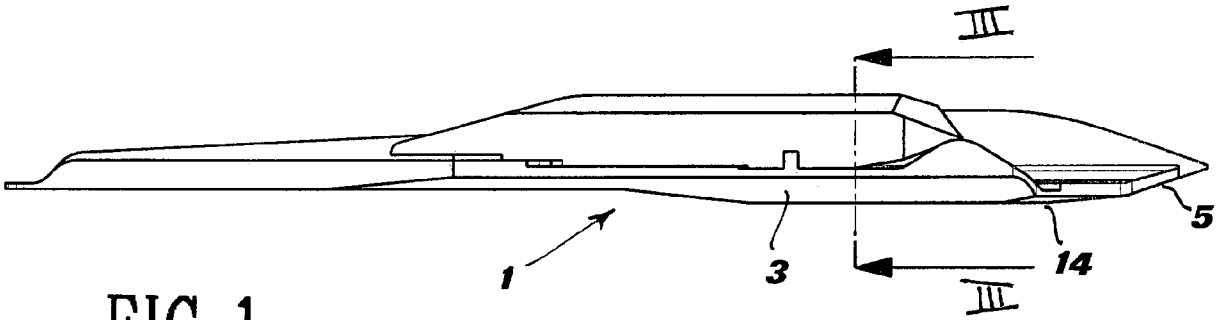
FIG. 1 is a side view of the carrying gripper of the pair of grippers according to the invention.
Figure 2:
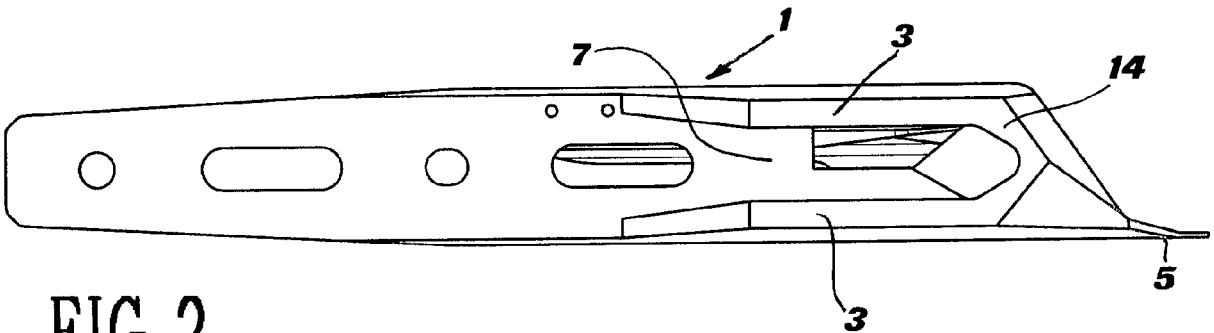
FIG. 2 is a bottom view of the carrying gripper in FIG. 1, whereof
Figure 3:
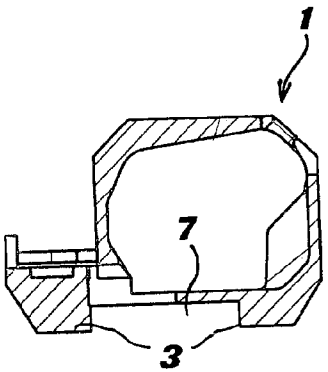
FIG. 3 is a transversal section along line III—III of FIG. 1.
Figure 4:
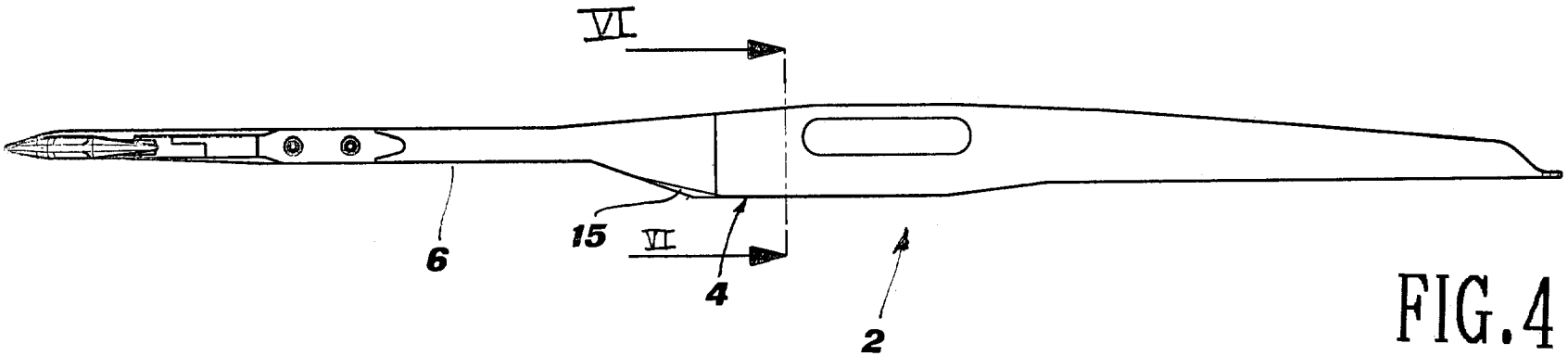
FIG. 4 is a side view of the drawing gripper of the pair of grippers according to the invention, whereof
Figure 5:
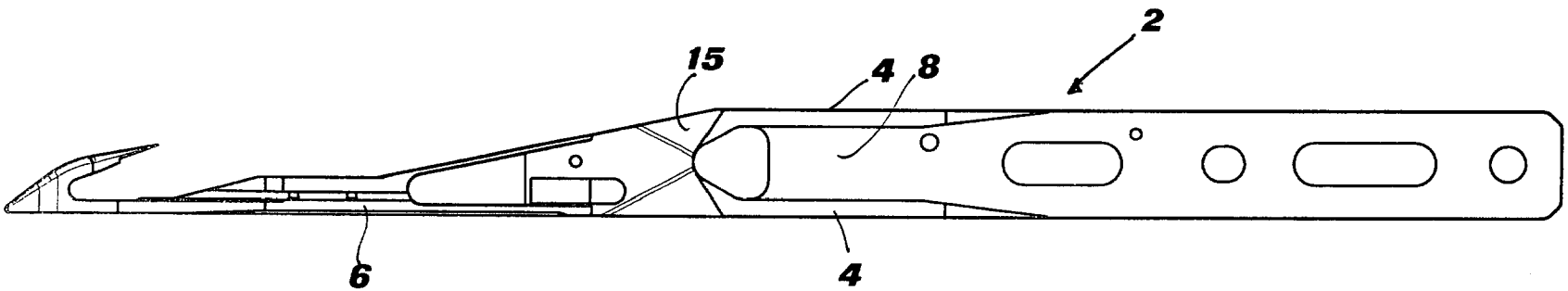
FIG. 5 is a bottom view.
Figure 6:
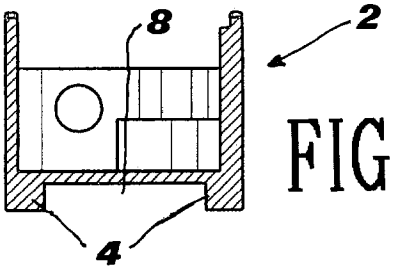
FIG. 6 is a transversal section along line VI—VI of FIG. 4.
Figures 7, 8, 9, 10:
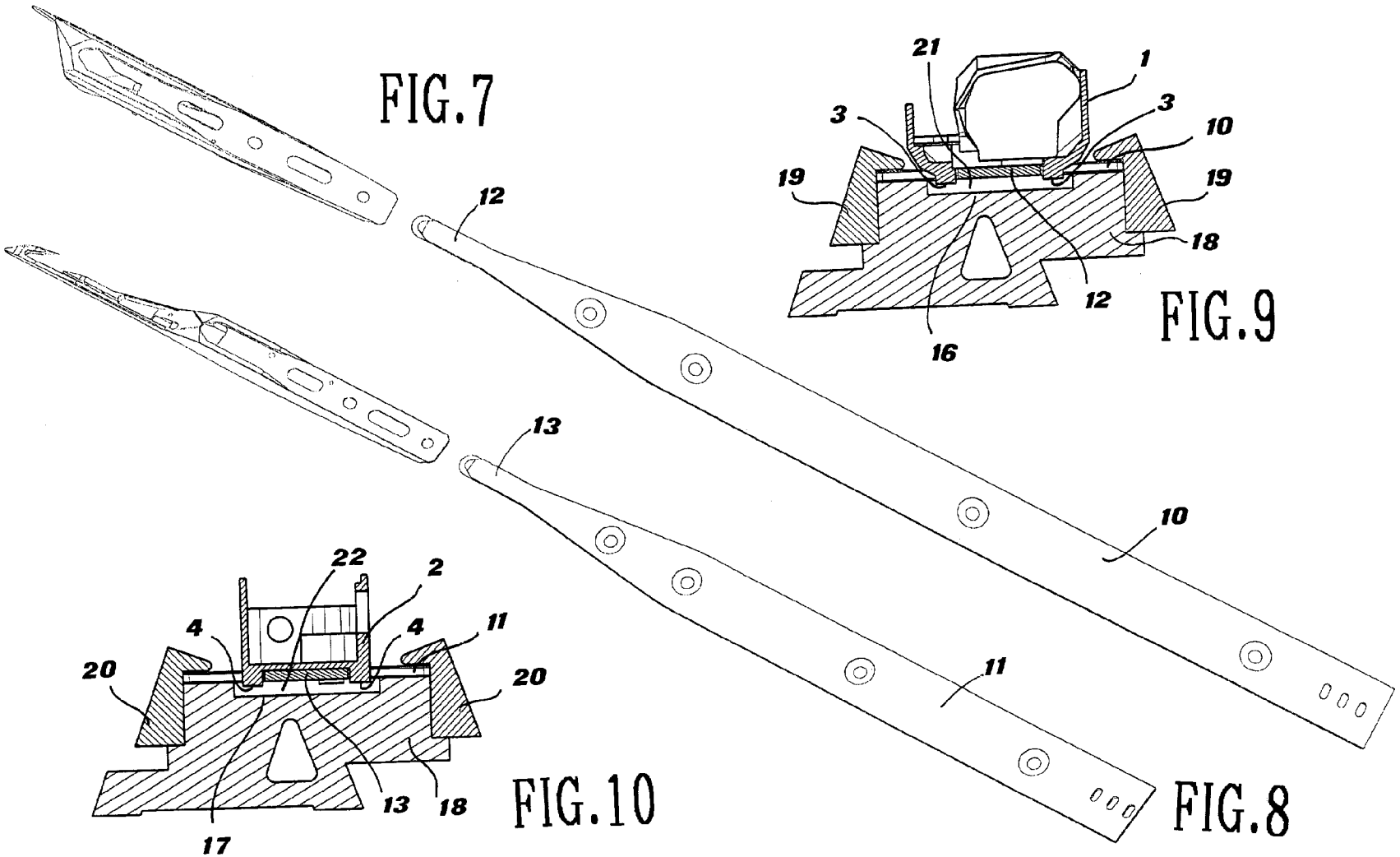
FIG. 7 is a perspective view of the end of the strap for the carrying gripper of FIGS. 1 to 3 and the way in which it is to be applied thereto.

FIG. 8 is a perspective view of the end of the strap for the drawing gripper of FIGS. 4 to 6 and the way in which it is to be applied thereto; and FIGS. 9 and 10 are front transversal sections of the tracks provided on the loom in order to form, together with pairs of guides external to the shed and with the grippers of FIGS. 1 to 3 and 4 to 6 respectively, the guiding means according to the invention.

With reference to the appended drawings, both the carrying gripper 1 (FIGS. 1 to 3) and the drawing gripper 2 (FIGS. 4 to 6) according to the invention, both of which are made of metal, are designed so as to have a metal shoe—3 and 4 respectively—integrated into said grippers and projecting from the bottom thereof respectively near the tip 5 of the former and the tip portion 6 of the latter. The shoe 3 is smoothly radiussed to the tip 5 of gripper 1 and so is the shoe 4 to tip portion 6 of gripper 2.

As shown in the drawings, both the shoe 3 of the gripper 1 and the shoe 4 of the gripper 2 have a large central recess—respectively 7 and 8—provided to host (see FIGS. 7 and 8) the differently profiled narrower ends—12 and 13 respectively—of the driving straps 10 and 11, which are otherwise identical to each other and quite larger than grippers 1 and 2. Straps 10 and 11 (equally thick) are furthermore quite thinner than recesses 7 and 8 of the shoes 3 and 4 of grippers 1 and 2.

The drawings also show that the shoe 3 is very near the tip 5 of the carrying gripper 1, to which said shoe is radiussed through a short tapered area 14, while the shoe 4 is placed inside the drawing gripper 2 near the area of the gripper body preceding tip portion 6 thereof and is radiussed thereto through a short tapered area 15.

FIGS. 9 and 10 are front views of parts 16 and 17, external to the shed, of a metal track coated with ceramic integrated in the sley 18 of the loom, on which grippers 1 and 2 move, driven by straps 10 and 11. In a known way, these straps, which are free within the shed, are guided outside the shed by double rows of opposed hooked guides 19 and 20.

According to the invention, the parts 16 and 17 of the track external to the shed have a large longitudinal central groove, 21 and 22 respectively, provided to host shoes 3 and 4 of grippers 1 and 2, in order to create an improved system to guide a pair of weft carrying grippers in their movement. In this system, the straps, which are quite larger than the grippers except near said grippers, as already explained, are very thin, and anyway quite thinner than recesses 7 and 8 of the shoes 3 and 4 of grippers 1 and 2. Inside the shed, the sley is coated with a soft cloth also along the path followed by grippers and straps.

In use, grippers and straps travel on the metal track with the straps being guided—outside the shed—by the double rows of hooked guides 19 and 20, and the shoes 3 and 4 of the grippers being hosted—also outside the shed—in grooves 21 and 22 of parts 16 and 17 of said track. Usually (and preferably), shoes 3 and 4 travel freely inside grooves 21 and 22, as illustrated in FIGS. 9 and 10, but they might also be accurately guided by the track. Anyhow, when grippers 1 and 2 enter the shed, nothing guides said grippers and the respective straps any longer, so they may advance freely between the two laps of warp yarns. The upper ones thereof press against the grippers, which are quite thick, but not against the straps, which are very thin. The lower warp yarns are pressed by the grippers and support the limited weight of the straps.

With the solution according to the invention, the relative movements between grippers and straps on the one hand and warp yarns on the other do not cause serious wear of the yarns, because—when the gripper passes—the upper warp yarns come into contact with the smooth metal of the top of the gripper and the lower ones come into contact with the smooth metal of the lower shoe provided by the invention (instead of the strap end, which is in an inner position relative to the shoe and is narrower than the gripper). When the straps pass, the warp yarns pressure against said straps is very low, given the extreme thinness of the straps, and no relevant wear occurs either in this case.

The solution according to the invention furthermore prevents, during the acceleration and deceleration of the straps, avoiding undesired vertical flexures of the strap/gripper assemblies, and therefore any potential negative collisions between the grippers and the ceramic layer of the track. In fact, metal shoes 3 and 4, integrated into grippers 1 and 2, can press directly onto parts 16 and 17 of the track, with which they can come into contact, eliminating all chances of collision during the various movements of said straps.

It is understood that other embodiments of the invention, different from the one described in detail above, may exist that fall completely within the scope of the present invention.

What is claimed is:

1. Pair of weft carrying grippers for weaving looms, the grippers made of metal and driven in their back-and-forth movement through the shed by carbon-fibre and/or polyester straps, guided exclusively outside the shed, wherein each of said grippers (1, 2) is provided with a metal shoe (3, 4) integrated in said gripper and projecting from the bottom thereof near the tip, to which it is smoothly tapered, and said shoe (3, 4) is provided with a large central recess (7, 8) provided to host the end (12, 13) of the driving strap (10, 11) which end is narrower than the rest of the strap and thinner than the shoe recess (7, 8).

2. Pair of grippers as in claim 1, wherein, in the carrying gripper, said shoe (3) is very near the tip (5), to which it is smoothly tapered through a short tapered area (14).

3. Pair of grippers as in claim 1, wherein in the drawing gripper, said shoe (4) is placed at the area of the gripper body preceding the tip portion of the gripper and is smoothly tapered thereto through a short tapered area (15).

4. Apparatus for guiding the movement through a loom shed of a pair of weft-carrying grippers (1, 2) as in claim 1, wherein, the driving straps (10, 11) of said grippers move on a metal track covered in ceramic, said straps (10, 11) are quite larger than the grippers (1, 2), except near said grippers, and are guided by two double rows of hooks (19, 20) or by a pair of grooved guides placed outside the shed, and at least the parts (16, 17) placed outside the shed of said track have a large central longitudinal groove (21, 22), provided to host the shoe (3, 4) of said grippers (1, 2).

5. Apparatus as in claim 4, wherein the shoe (3, 4) of said grippers (1, 2) moves freely within said groove (21, 22) of the parts (16, 17) outside the shed of said track.

6. Apparatus as in claim 4, wherein the shoe (3, 4) of said grippers is guided in said groove (21, 22) of said track.

7. A weft gripper for weaving looms, made of metal and driven in a back-and-forth movement through a shed by one of a carbon-fibre driving strap and a polyester driving strap guided exclusively outside the shed, wherein said gripper is provided with a metal shoe (3, 4) integrated in said gripper (1, 2) and projecting from the bottom thereof and smoothly tapered towards the tip thereof, and said shoe (3, 4) is provided with a large central recess (7, 8) provided to host the end (12, 13) of the driving strap (10, 11), which end is narrower than the rest of the strap and thinner than the shoe recess (7, 8).

8. Apparatus for guiding the movement through a loom shed of a weft gripper (1, 2) as in claim 7, wherein, the driving strap (10, 11) of said gripper moves on a metal track covered in ceramic, said strap (10, 11) being quite larger than the gripper (1, 2), except within said central recess of the gripper, and being guided by two double rows of hooks (19, 20) or by a pair of grooved guides placed outside the shed, and at least the parts (16, 17) placed outside the shed of said track have a large central longitudinal groove (21, 22) provided to host the shoe (3, 4) of said gripper (1, 2).

9. The weft gripper of claim 7, wherein the metal shoe is shaped to retain driving strap within said recess along the entire length of the gripper so that the driving belt cannot come into contact with the warp threads or into contact with a track upon which the gripper moves.

10. A pair of grippers of claim 1, wherein the metal shoe is shaped to retain driving strap within said recess along the entire length of the gripper so that the driving belt cannot come into contact with the warp threads or into contact with a track upon which the gripper moves.

* * * * *